United States Patent [19]

Hollaway

[11] Patent Number: 4,634,957

[45] Date of Patent: Jan. 6, 1987

[54] REMOTELY CONTROLLED LIGHT FLASHER

[76] Inventor: Jerrell P. Hollaway, 1330 Meadowbrook Rd., NE., Palm Bay, Fla. 32905

[21] Appl. No.: 827,088

[22] Filed: Feb. 7, 1986

[51] Int. Cl.[4] ..... G05F 1/40

[52] U.S. Cl. ..... 323/242; 323/239; 307/252 B

[58] Field of Search ..... 323/322–326, 323/241, 242, 237, 239; 307/252 B

[56] References Cited

U.S. PATENT DOCUMENTS

| | | | |
|---|---|---|---|
| 3,201,597 | 8/1965 | Balan | 323/324 X |
| 3,999,176 | 12/1976 | Kellogg et al. | 340/331 X |
| 4,155,015 | 5/1979 | Nakasone et al. | 307/252 B |
| 4,255,699 | 3/1981 | Calvin | 323/322 |
| 4,290,006 | 9/1981 | Wallace | 323/324 X |
| 4,314,197 | 2/1982 | Sandler et al. | 323/324 |
| 4,322,632 | 3/1982 | Hart et al. | 307/41 |
| 4,338,562 | 7/1982 | Terwilliger | 323/323 |
| 4,426,615 | 1/1984 | Hannas | 323/322 |
| 4,480,197 | 10/1984 | Hollaway | 307/252 N |
| 4,500,795 | 2/1985 | Hochstein et al. | 323/323 X |

OTHER PUBLICATIONS

R. W. Fox, "Flashers, Ring Counters, and Chasers", General Electric, Dec., 1969.

*Primary Examiner*—Peter S. Wong
*Assistant Examiner*—Marc S. Hoff

[57] ABSTRACT

A control circuit for selecting different modes of operation for an outside building light which is operated by interrupting the current to the control circuit from a standard wall switch.

The First mode of operation is continuous light for normal use. The second mode produces a flashing light which can be used for alert conditions.

The initial application of power from the wall switch always produces the continuous light mode. The second mode can then be selected by switching the power off and then rapidly back on. The control circuit is installed at the light in an adaptor between the bulb and the bulb's socket and can therefore be used without requiring any changes to the switches or existing wiring of the building.

19 Claims, 8 Drawing Figures

REMOTELY CONTROLLED LIGHT FLASHER

BACKGROUND OF THE INVENTION

This invention relates to control circuits and switch apparatuses that can selectively cause a light to either flash on and off or operate continuously, as desired.

For some time now it has been recognized that being able to cause the porch light of a home to flash on and off can be useful. A flashing porch light can be an indication to neighbors that someone inside is helplessly ill, frightened by prowlers or needs some other emergency assistance. An obvious need for such a flashing light is to help emergency vehicles find a particular address after being summoned by telephone. In urban areas, there are often many houses that look similar and identifiable only by house numbers, which can be difficult to see at night. In rural areas, where roads and houses may not be marked with names or numbers, directions must be given by landmarks alone. It is clear that a flashing outside light would be very helpful in these situations.

Various approaches to providing both a flashing light and a continuous light from the same bulb are known in the prior art. U.S. Pat. No. 4,177,408 describes a switch apparatus used with existing wiring and light fixtures that derives its flashing action from a thermally-activated flasher disc. U.S. Pat. No. 4,556,863 discloses a switch apparatus used in a similar manner but with an electronic flashing circuit. Both of these inventions, being replacement switch apparatuses, require careful installation into the building's wiring system; a task which is, unfortunately, beyond some homeowners' skills.

U.S. Pat. No. 4,547,761 describes a special, battery-powered lamp post that can be activated by radio control from inside the house. While this does provide remote control for the light and avoids certain problems with wiring or switch changes, it is obviously a costly solution to the problem at hand.

SUMMARY OF THE INVENTION

A primary object of this invention is to provide a light control circuit which can be easily installed between the bulb and its existing socket, thereby avoiding changes to existing power switches or wiring.

A second object is to be able to select between a flashing light and a normal light from a remote location, namely, at an existing power switch.

A third object is for such a control circuit be safe, reliable and simple in design, requiring few parts and a small housing so that it will be inexpensive and will fit into a majority of existing outside light fixtures, making it available to as many homes as possible.

The present invention is a control circuit that can be placed between the bulb and the power source by means of a screw-in socket adaptor that has first and second input terminals adapted to receive an application of power from an electrical power source and first and second output terminals that are adapted to be coupled to an electrical load. The power control circuit within the adaptor is responsive to interruptions of power from an existing manually operated power switch, allowing the user to select between normal use and emergency use. When the adaptor is in place and power is applied from the switch in a conventional manner, an effectively continuous application of power is provided and the light comes on normally and continues until the power is turned off at the switch. After a minimum wait of 1–2 seconds, the circuit will again operate conventionally. If, however, while the light is on, power is turned off and then within a short period of time quickly back on, the control circuit will cause the light to operate in a flashing mode, due to the repeated application and interruption of power. The flashing mode will continue until power is turned off. Thus, the user can easily choose between two different timing characteristics for the light by opening and closing a remotely located power switch.

The control circuit consists of a controlled solid sate main power switch circuit, an oscillator circuit that controls the flashing rate, a logic circuit that dictates the mode of operation, an AC to DC power supply circuit, and a housing structure that interfaces between the bulb and the bulb's socket The power switch employs a thyristor type semiconductor. If only a SCR is used, the control circuit supplies one-half power to the bulb in both modes of operation. The present invention also works well with a TRIAC, however, so that full power can be applied to the bulb in both the continuous mode and the flashing mode.

The oscillator that is preferred is a simple relaxation oscillator that uses a neon lamp or a semiconductor device, such as a DIAC, as the active circuit element. Various other oscillator schemes, including those using integrated circuits, are available. The control circuit that includes the oscillator is located at the bulb and has access to the full line voltage at all times. Therefore, the duty cycle of the oscillator is practically unrestricted. (The bulb can be either on or off for relatively long periods without affecting operation of the control circuit.)

Several different logic circuits are illustrated in the present disclosure. One logic circuit uses two transistors which are uniquely configured in a circuit so as to have one state of conduction following a short interruption of power and a different state of conduction following a longer interruption.

For simplicity of design, a half-wave rectifier power supply is used to convert the AC line voltage to a suitable level of DC voltage.

The complete control circuit, constructed with semiconductor devices as disclosed, is small enough in size to fit into various forms of housing used as screw-in socket adaptors, allowing the control circuit to be placed adjacent to the bulb.

DESCRIPTION OF THE PREFERRED EMBODIMENTS

Figure 1:
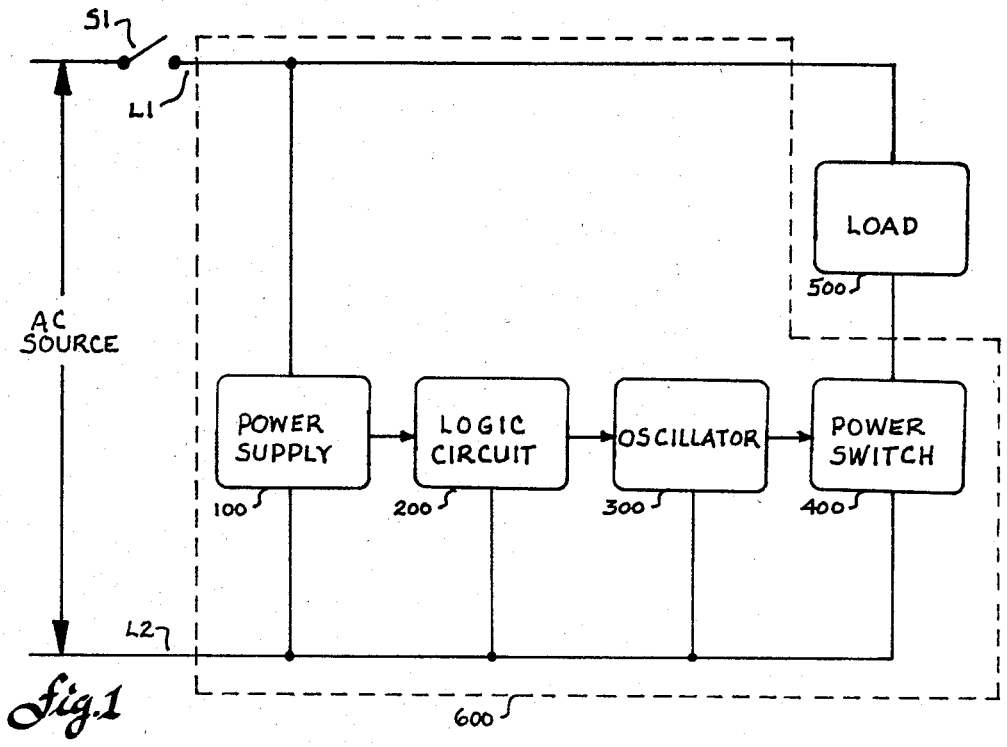
FIG. 1 is a general block diagram of the control circuit.

Referring to FIG. 1 of the drawings, a block diagram represents the main elements of the present invention in all of its preferred embodiments. Subcircuits 100, 200, 300 and 400 are interconnected on a small printed circuit board which is housed in screw-in socket adaptor 600 between load 500 (a bulb) and electrical transmission lines L1 and L2.

S1 is illustrated as a single-pole, single-throw switch in line L1; however, S1 may be any type of switch (or any other means for interrupting power) at any point in Lines L1 or L2.

Power Supply circuit 100 supplies rectified and filtered DC power to control logic circuit 200, oscillator circuit 300 and controlled switch circuit 400.

Logic circuit 200 responds to power interruptions at switch S1 and allows oscillator 300 to supply switch 400 with a periodic input signal following a brief interruption or with a steady input signal following a long interruption. Together, logic circuit 200 and oscillator 300 form a control generator.

Controlled power switches current through load 500 according to the nature of its inputs. A periodic input from oscillator 300 causes a flashing light as a result of short intervals of conduction by power switch 400. A steady input, on the other hand, causes essentially continuous conduction by switch 400 and a continuous, or normal, light.

Each of the following detailed descriptions of preferred embodiments is consistent with the block diagram of FIG. 1 and the method of operation just described.

Figure 2:
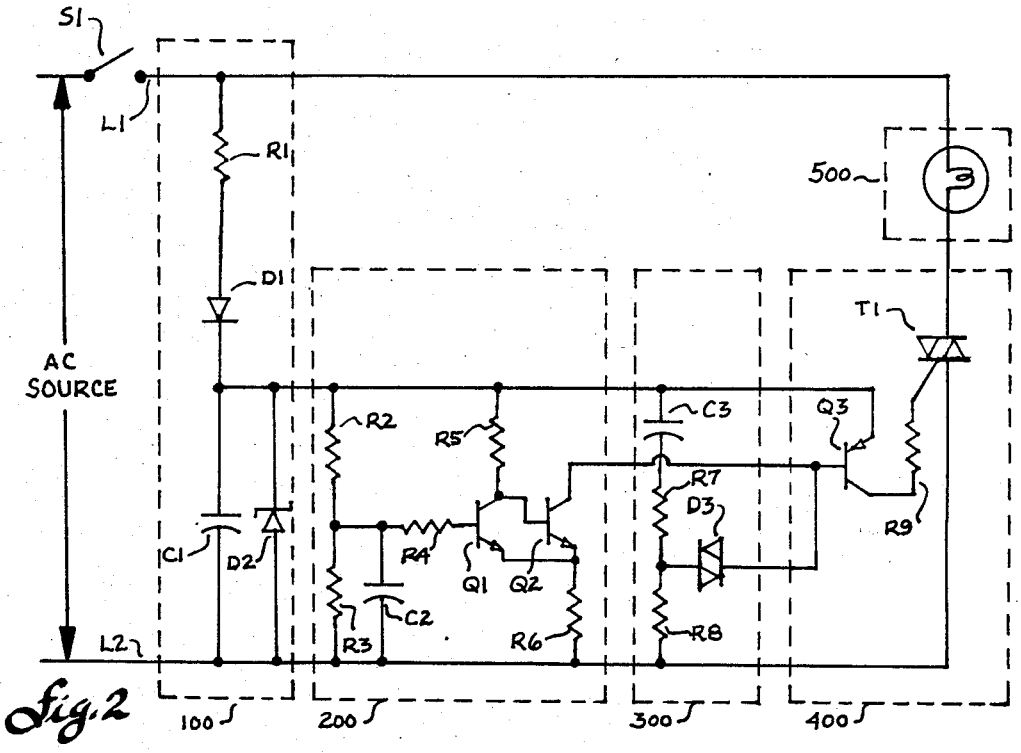
FIG. 2 is a schematic diagram of a preferred embodiment of the control circuit.

Referring to FIG. 2 for the first preferred embodiment, power supply 100 consists of resistor R1, diode D1, capacitor C1, and zener diode D2, connected between lines L1 and L2 as shown. Resistor R1 is used to drop the voltage of the AC source to a level within the maximum rating of the selected circuit components. Diode D1 performs a standard AC to DC conversion. C1 filters the rectified power and attempts to maintain a steady DC voltage level during the negative half-cycles of the AC source. Zener diode D2 sets a maximum level that the DC voltage can rise to during periods of low current demands by the remaining subcircuits.

Logic Circuit 200 is comprised of resistors R2, R3, R4, R5, and R6; capacitor C2; and transistors Q1 and Q2. R2 and R3 form a voltage divider between the output and the return of DC power supply 100. Capacitor C2 is connected to the junction of R2 and R3 so that its steady state charge is dictated by the selected values of R2 and R3. Resistor R4 is connected between capacitor C2 and the base of transistor Q1. The purpose of R4 is to control the rate of discharge of C2 when the baseemitter junction of Q1 becomes conductive. NPN transistors Q1 and Q2 are configured such that the collector of Q1 is connected to the base of Q2 and this junction is connected to the output of the power supply through R5. The emitters of the two transistors are connected together and then to the return side of the power supply through resistor R6. The output of the logic circuit appears at the collector of Q2, which is connected to the base of PNP transistor Q3.

Logic circuit 200 operates in the following manner: When switch S1 is initially closed and a DC voltage is produced by power supply 100, resistor R5 provides current to the base of transistor Q2 which causes Q2 to become highly conductive (saturated). Resistor R6 limits the amount of emitter current from transistor Q2 and establishes a voltage at the emitters of Q1 and Q2 which is essentially the output voltage of power supply 200 (less only the emitter/base voltage drop of Q3 and the collector/emitter voltage drop of Q2). By design, this voltage at the emitters of Q1 and Q2 is greater than the voltage across capacitor C2 as set by the voltage divider network of resistors R2 and R3. This being the case, the base-emitter junction of Q1 is reverse-biased. Thus Q1 is non-conductive whenever Q2 is conductive.

If power to the control circuit is now somehow interrupted, usually by opening switch S1, transistor Q2 will continue to conduct for a short period from the stored charge in capacitor C1, but the voltage drop across resistor R6 will become less and less as the emitter current from Q2 decrease with the decreasing charge in C1. Finally, a point will come where the voltage across C2 is greater than the voltage across resistor R6, and the base-emitter junction of transistor Q1 will become forward-biased through resistor R4. (The time constant of capacitor C2 and resistor R3 is relatively long). As soon as Q1 becomes highly conductive, Q2 will be turned off for lack of base drive, as the voltage drop between the collector and emitter of Q1 is in the order of only 0.2 volts when Q1 is saturated, and the baseemitter junction of Q2 needs a higher input voltage for Q2 to be conductive. If switch S1 is now quickly closed, restoring power to the circuits, Q1 will remain on and Q2 will remain off. (Power msut be restored, obviously, before capacitor C2 is totally discharged through resistor R4 if Q1 is to remain on). Many combinations of values for C2 and R4 may be used to provide an adequate time constant. It should be pointed out that the time constant of resistor R2 and capacitor C2 must be large enough that transistor Q2 always becomes conductive on the initial application of power before C2 has reached a voltage level sufficient to turn on Q1. Finally, if S1 is opened for a long period of time (more than 1 or 2 seconds) instead of a brief period, transistors Q2 will again become conductive before Q1, just as if Switch S1 has been opened for a very long time (overnight). This is because Q1's brief period of conductivity will have transpired while S1 was open and thus no effect will be seen.

Oscillator 300 consists of capacitor C3, resistors R7 and R8, and DIAC D3. These components form a relaxation oscillator. Capacitor C3 is connected to the output of power supply 100 and to one end of resistor R7. Resistor R7 serves to limit the discharge rate of C3 when oscillator 300 is operating. The other end of R7 is connected to the junction of resistor R8 and DIAC D3. R8 is then connected to the return of power supply 100, completing the charging path for C3. The other end of D3 is connected to the output of power supply 100 through the baseemitter junction of transistor Q3.

In operation, C3 is slowly charged by the output of power supply 100 through R7 and R8 until the breakdown voltage of D3 is reached, at which time C3 discharges through R7, D3 and the baseemitter junction of Q3. As soon as C3 is discharged to the point that the voltage across D3 is less than its substaining voltage, D3 becomes non-conductive and the cycle begins to repeat itself. A wide range of duty cycles is possible through proper selection of values for C3, R7 and R8, as well as selection of the breakdown voltage of D3. In general, when C2 has a certain value of capacitance, R8 controls the amount of time D3 is non-conductive (oscillator 300 is off) and R7 controls the amount of time D3 is conductive (oscillator 300 is on).

Power switch 400 consists of PNP transistor Q3, resistor R9 and TRIAC T1. The emitter of Q3 is connected to the output of power supply 100 and the collector is connected to the gate of TRIAC T1 through R9. Resistor R9 limits the amount of current through the gate of T1. The base of Q3 is connected to both the output of logic 200 and the output of oscillator 300 at the collector of Q2 and the right side of DIAC D3, respectfully. Main terminal 1 of T1 is connected to the return of power supply 100, which is also Line L2 from the AC source. Main terminal 2 of T1 is connected to one side of load 500.

In operation, power switch 400 provides a current path between the AC source and load 500 when the output of either logic 200 or oscillator 300 provides a current path for the base og Q3. When a small amount of emitter-to-base current is allowed to flow in Q3, a larger amount of current flows from power supply 100 through Q3 and R9 to the gate of T1.

Load 500 is normally an incandescent bulb of any practical wattage, consistent with the power handling capabilities of TRIAC T1. Load 500 an be connected in series line L1 and main terminal 2 of T1 or between Line 2 and main terminal 1 of T1. In this embodiment, however, the connection of load 500 is preferred as shown in order to limit total power dissipation in Q3 and R9.

In combination then, sub-circuits 100, 200, 300 and 400 in FIG. 2 control load 500 in the desired manner. On the initial application of power at switch S1, power supply 100 provides a DC voltage at the base of Q2, making Q2 conductive. Q2, in turn, turns on Q3. Transistor Q3 then provides gate drive for T1 so that load 500 is continuously energized by T1. If a brief power interruption is now caused at S1, Q1 will become conductive and, due to the signal inverting characteristic between base and collector, will force Q2 off. Now the only source of gate current for Q3 is the periodic discharge of C3 through D3. Q3 will thus furnish gate current to T1 in short intervals, causing T1 to control power to load 500 in a like manner. The overall result in this mode is the appearance of a flashing light from load 500.

Figure 3:
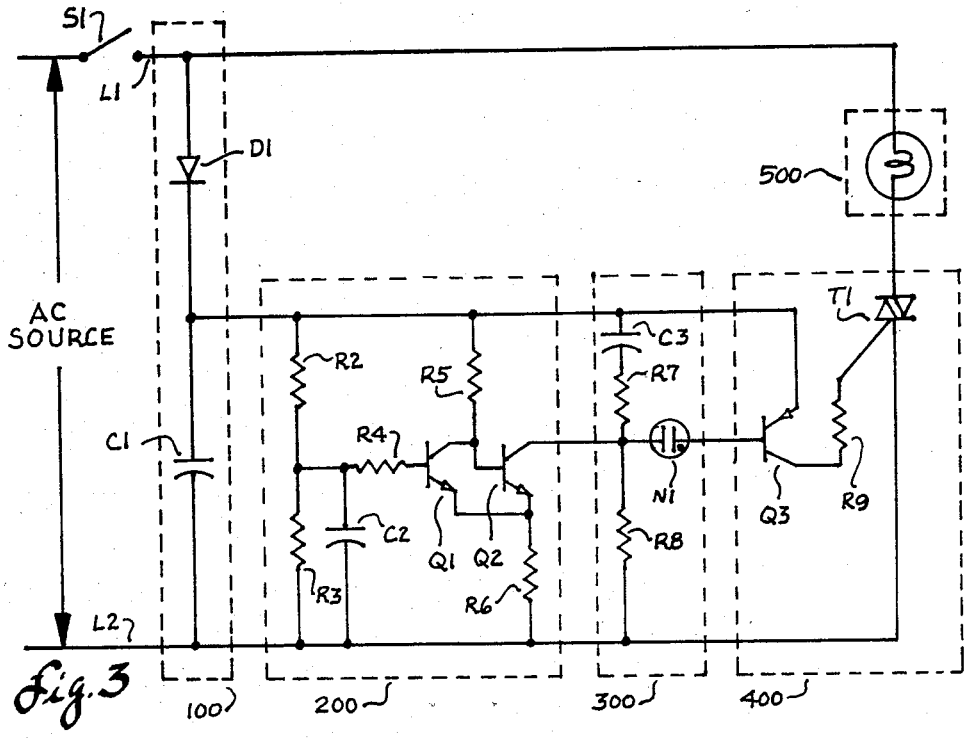
FIG. 3 is a schematic diagram of a preferred embodiment with a different oscillator and power supply.

FIG. 3 illustrates another preferred embodiment of the control circuit. The difference in this embodiment from that of FIG. 2 is in oscillator 300 and the way that it is connected between logic circuit 200 and power switch circuit 400. Logic 200 and power switch 400 are exactly the same as previously described and need not be discussed again. Power supply 100 is similar also, except that there is no resistor in series with D1 and no zener diode across C1 for voltage regulation. (In this embodiment a higher, unregulated DC voltage is furnished to oscillator 300 by power supply 100.)

Oscillator 300 of FIG. 3 uses neon lamp N1 in place of a DIAC as the active circuit element. One side of N1 is connected to the RC network comprised of C3, R7 and R8, as well as the output of logic circuit 200 (the collector of Q2). The other side of N1 provides the only connection to the base of Q3 (the input for power switch 400).

In operation, when Q2 is off, C3 slowly charges through R7 and R8 until the breakdown voltage of N1 is reached. C3 then discharges through R7, N1 and the base-emitter junction of Q3. R7 serves to limit the rate of discharge, which protects the components and also provides a longer period of conduction for Q3. When the voltage across C3 drops below the sustaining voltage of N1, neon bulb N1 stops conducting and the cycle begins to repeat itself. The resulting periodic conduction of Q3 causes power switch 400 to supply power to the load on a periodic basis.

When Q2 is on, on the other hand, a steady current path for N1 is provided through Q2 and R6 and the periodic charge and discharge of C3 will not occur. Thus, with continuous current through the base-emitter junction of Q3, power switch 400 will furnish continuous power to load 500.

Figure 4:
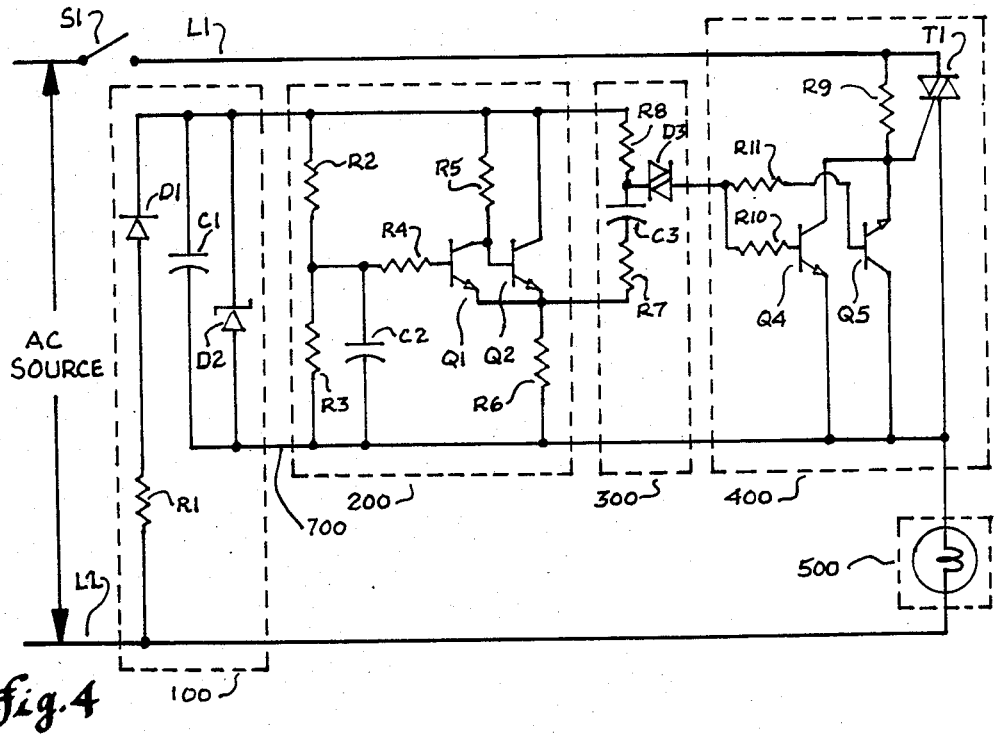
FIG. 4 is a schematic diagram of a preferred embodiment with a different power switch circuit.

FIG. 4 discloses another preferred embodiment that has the same power supply 100, logic 200, oscillator 300 and load 500 as the embodiment disclosed in FIG. 2, although each is connected into the overall control circuit in a different way (for reasons which will become apparent). Power switch circuit 400 is unique to this embodiment and operates in a completely different manner than others discussed.

Resistor R9 is connected between line L1 and the gate of TRIAC T1 so as to normally provide gate current for T1 whenever switch S1 is closed. NPN transistors Q4 and Q5, however, are connected back-to-back as current shunts between the gate terminal and main terminal 1 of T1. Whenever base current is supplied through R10 and R11, the respective base resistors for Q4 and Q5, one transistor will shunt, or bypass, a majority of the required gate drive for T1 on the positive half of the AC cycle and the other transistor will shunt the current on the negative half of the cycle, thereby causing T1 to be non-conductive as long as base currents flow through R10 and R11.

When Q2 is on, T1 is allowed to provide continuous power to load 500; however, when Q2 is off, the RC network of R7, R8 and C3 connected across the collector and emitter of Q2 will cause D3 to periodically conduct current from C3, as previously described, now through the parallel paths of R10/Q4 and R11/Q5 and on through R6 and R7 to C3 again. Whenever current from C3 flows through this path, Q4 and Q5 will prevent T1 from delivering power to load 500. As soon as C3 is discharged to the point that D3 stops conducting, the base currents will disappear and the shunting effect of Q4 and Q5 will be lost. Now R9 will be able to drive T1 into full conduction and load 500 will be energized, until the cycle repeats, resulting in a flashing light.

Load 500 is shown connected between line L2 and 700, the return of power supply 100. The input of power supply 100 is now connected to line L2 through R1 so as to charge C1 at times when T1 is conducting and most of the voltage from the AC source is across load 500. All other aspects of this embodiment are like those previously discussed.

Figure 5:
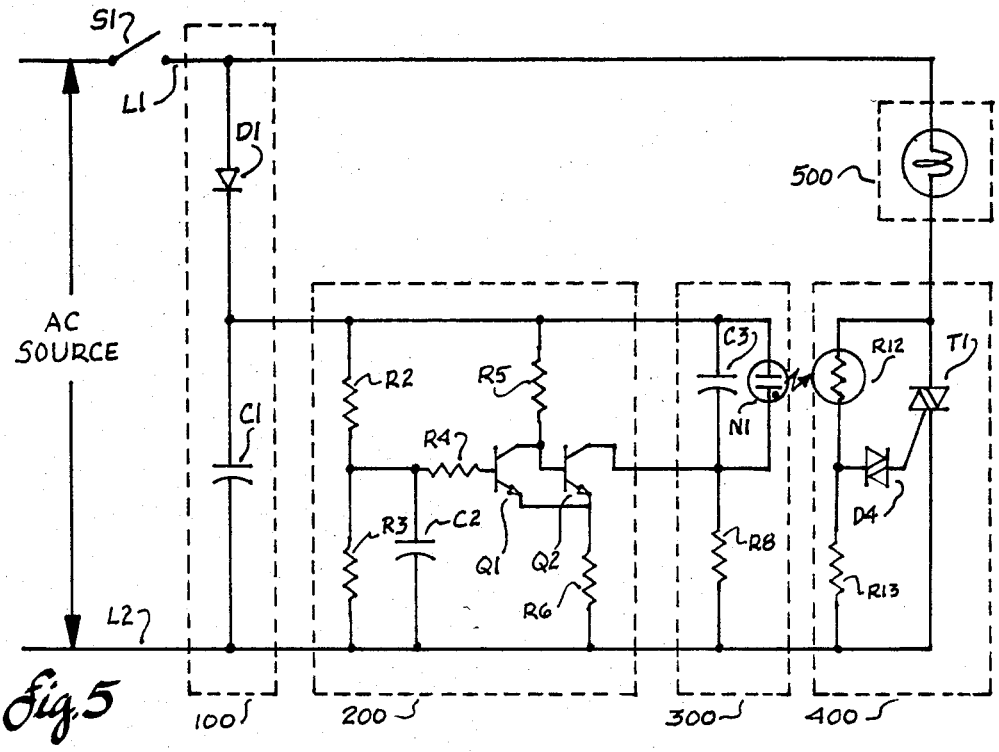
FIG. 5 is a schematic diagram of a preferred embodiment with the oscillator being optically-coupled to the power switch circuit.

FIG. 5 illustrated a different power switch 400 with optically-coupled oscillator 300. Power supply 100, logic 200 and load 500 are exactly like those previously described.

Resistor R12, a light-sensitive photocell, is connected in series with resistor R13 across the main terminals of TRIAC T1 so as to form a voltage divider. DIAC D4 is connected between the output of the voltage divide and the gate of T1.

Capacitor C3 is connected between the output of power supply 100 and R8 which completes a charging path to the return of power supply 100. Neon lamp N1 is connected in parallel with C3, forming a conventional relaxation oscillator. The junction of C3 and R8 is connected to the output of logic 200 at the collector of Q2. Neon lamp N1 and light-sensitive resistor R12 are placed in close proximity to each other to allow optical coupling.

In operation, the values of R12 and R13 are selected so that when there is no light on R12 the voltage available to D4 is less than its breakdown voltage and T1 will receive no gate drive. When Q2 is off, however, C3 will periodically charge through R8 and discharge through N1, causing a burst of light to fall on R12. As R12 is illuminated by N1 its resistance drops low enough to deliver a voltage to D4 that is higher than the breakdown voltage of D4. Due to the inherently-slow response time of photocells, the resistance of R12 will remain low long enough for D4 to be conductive, bidirectionally, for several AC cycles, even though the flash of light from N1 was very brief. (For this reason it is not necessary to slow the rate of discharge of C3 with a resistance, as was done in previously discussed circuits.)

If logic circuit 200 dictates that Q2 is on, N1 has a steady current path through Q2 and R6, and thus R12 has a steady source of illumination, which will result in steady current through T1 and a constantly burning light from load 500.

Figure 6:
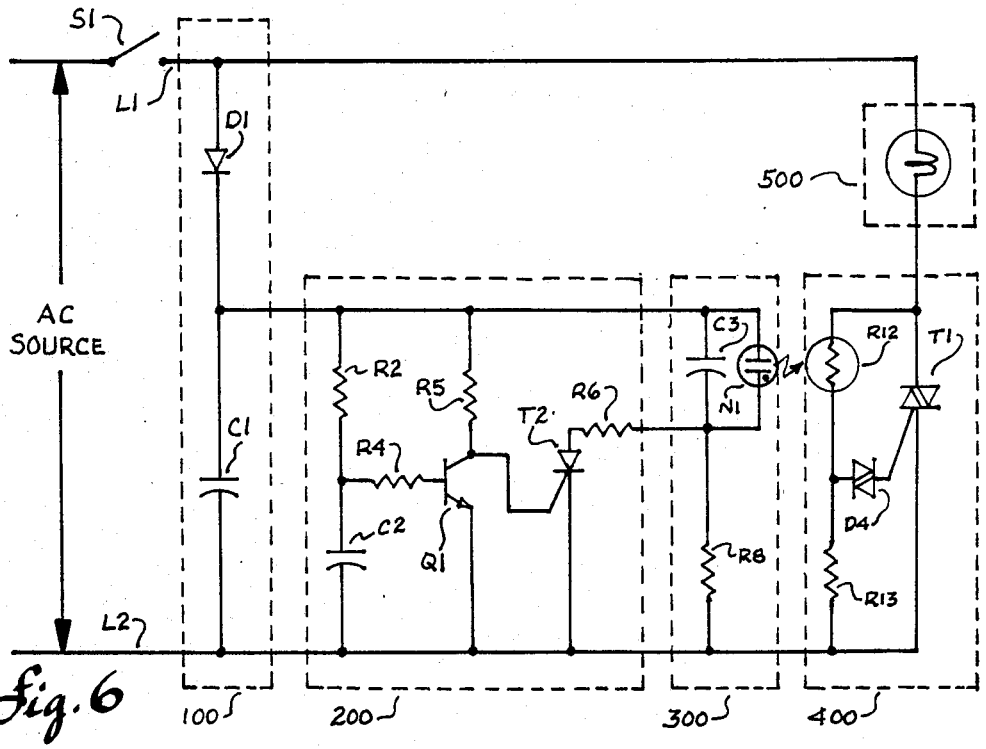
FIG. 6 is a schematic diagram of a preferred embodiment with a different logic circuit that employs a SCR.

FIG. 6 is a preferred embodiment that uses power supply 100, oscillator 300, power switch 400 and load 500 that have already been described in detail. Unique to this embodiment is logic circuit 200.

Resistor R2 connecte C2 to the output of power supply 100. The other side of C2 is connected to the return of power supply 100. R4 is connected between C2 and the base of Q1 for the purpose of providing a long time constant for the discharge of C2. Transistor Q1 is connected as a current shunt between the gate and cathode of thyristor T2 (a SCR). The source of gate current for T2 is through resistor R5 which is connected between the gate of T2 and the output of power supply 100. The cathode of T2 is connected directly to the return of power supply 100, while N1 and C3 in parallel are connected, through R6, between the anode of T2 and the output of power supply 100. (R6 serves as a current-limiting resistor for N1.)

In operation, when S1 is closed, R5 immediately furnishes gate curernt for T2 which, in turn, provides a continuous path for current through N1 and R6. The light from N1 falls on R12 and a continuous light results from load 500, as previously explained. Shortly after T2 becomes conductive, however, the charge on C2 is great enough for Q1 to be turned on by the current through R4. Q1, now being in saturation, shunts all of the available current from R5 to the return of power supply 100. Thyristors have regenerative characteristics, however, and once turned on remain on as long as a minimum holding current is provided. Therefore, the action of Q1 has no effect on T2 at this time. Now if S1 is opened briefly, T2 will quickly exhaust the charge in C1 of power supply 100 and will drop out of conduction. Q1 will remain on, however, as the time constant of C2 and R4 are relatively long. If S1 is reclosed with Q1 still on, T2 will not be allowed to come on because of the shunting action of Q1. Now with T2 non-conductive, C3 will charge slowly through R8 until the breakdown voltage of N1 is reached. C3 then discharges through N1 and the cycle begins to repeat with the same effect as previously described.

Figure 7:
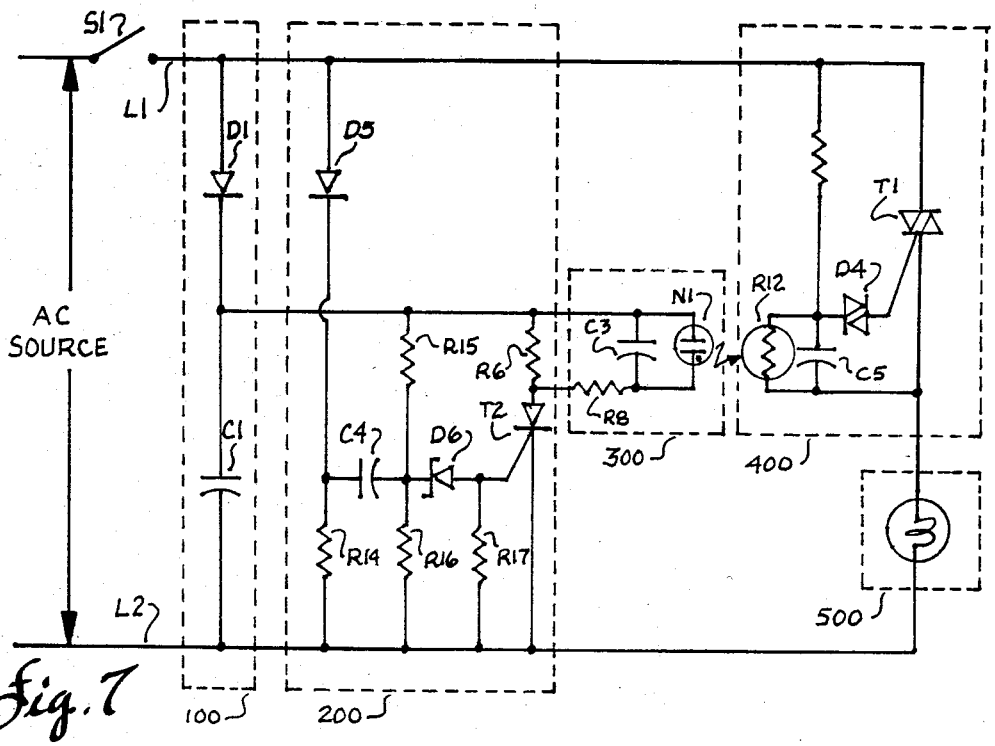
FIG. 7 is a schematic diagram of a preferred embodiment that uses integrated circuits as logic elements and is optically-coupled to a different power switch circuit.

FIG. 7 is another preferred embodiment that includes power supply 100, oscillator 300 and load 500 as described in previous embodiments but with unique logic circuit 200 and unique power switch 400.

Diode D5 in logic circuit 200 of FIG. 7 is connected between line L1 and resistor R14 so as to impress the positive half of the waveform from the AC source across R14. C4 is connected to R14 for the purpose of coupling the resulting signal to the anode of zener diode D6. also connected to the anode of D6 is the output and the reutrn of a voltage divider made by R15 and R16 connected across the output of power supply 100. The cathode of D6 is connected to the gate of thyristor T2 (a SCR) which is terminated by resistor R17. R6 connects the anode of T2 to the output of power supply 100. Oscillator 300 is connected across R6 so as to be operable only when T2 is conductive an there is a voltage drop across R6.

Power switch 400 in FIG. 7 is optically coupled to oscillator 300 through N1 and R12. Resistor 13 and resistor 12, a photocell, form a voltage divider across the main terminals of TRIAC T1. C5 is connected in parallel with R12. DIAC D4 is connected between the output of the R12/R13 voltage divider and the gate terminal of T1 so as to place T1 in conduction whenever the breakdown voltage of D4 is exceeded at the output of the voltage divider.

In operation, on initial application of power at S1, D5 impresses a positive voltage on the left side of C4 which, due to the nature of capacitors, is transferred to the right side of C4 (in the first instant). The zener voltage of D6 has been selected, however, so that this initial voltage from C4, which is essentially the peak positive level of the AC source, is less than the breakdown voltage of D6, and T2 will, therefore, not receive gate current and go into conduction. This means that there is no voltage drop across R6 and oscillator 300 does not operate. With no light from neon lamp N1, R12 has a high resistance value, which allows R13 to charge C5 early in each AC half-cycle. C5 then discharges through D4, turning on T1 in a manner which is now a well known practice when using TRIACS.

If power is now interrupted at S1, C4 will quickly charge to the present voltage potential of C1 through R14 and R15. When power is suddenly restored at S1, diode D5 will again impress a positive voltage on the left side of C4. But now that C4 has a positive charge across it, the resulting voltage on the right side of C4 is much higher than before and will exceed the zener breakdown voltage of D6. SCR T2 thus receives gate current for a short instant and goes into conduction. (T2 will remain in conduction even after its gate current disappears due to its regenerative characteristic.) With T2 conductive and voltage drop across R6, oscillator 300 begins to operate and deliver periodic bursts of light to R12. Each time R12 receives illumination its resistance becomes very low (and stays low for several Ac cycles because of its inherent response-time delay). With R12 being a low resistance, C5 is unable to charge to a voltage that will exceed the breakdown voltage of D4, so T1 is non-conductive for several AC cycles and load 500 has a noticeable interruption in power, as demonstrated by the light which periodically goes out and then flashes back on.

Anytime S1 is left open for more than a second or two (depending on component values), C4 will discharge through R14 and R16 and logic circuit 200 will return to its intiial state upon closure of S1. Oscillator 300 will then not operate and load 500 will recieve continuous power.

Figure 8:
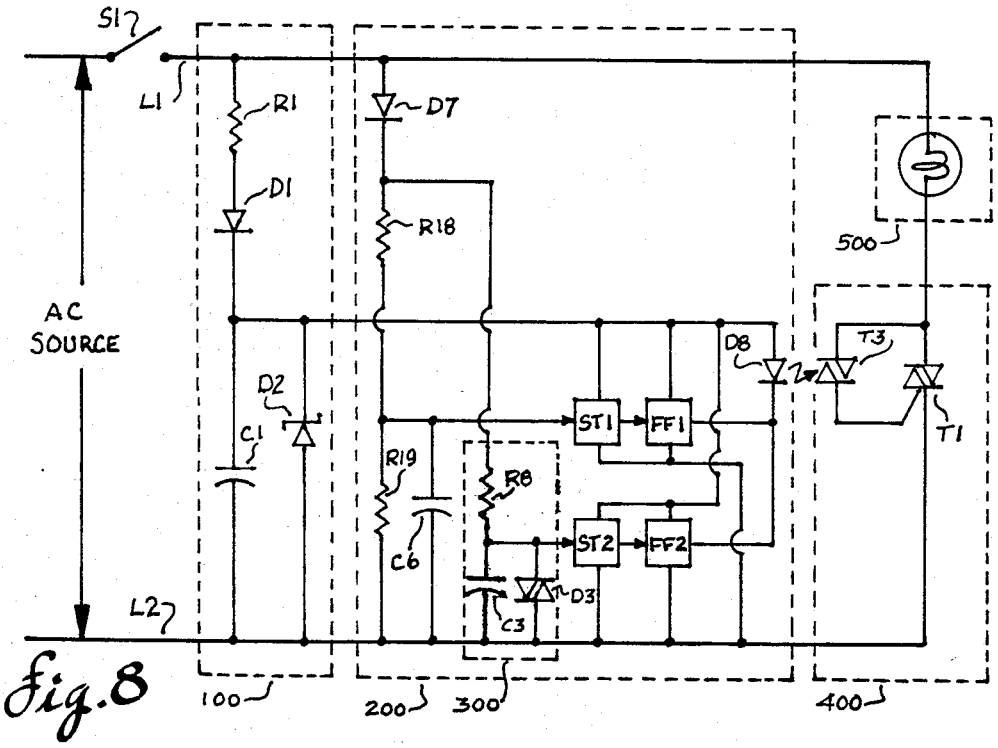
FIG. 8 is a schematic diagram of a preferred embodiment that uses an unique SCR logic circuit with the oscillator being optically-coupled to a power switch circuit that operates in a different manner.

FIG. 8 presents a preferred embodiment with unique logic circuit 200, oscillator 300 and power switch 400, in conjunction with familiar power supply 100 and load 500.

R18 and R19 form a voltage divider that is connected across lines L1 and L2 through D7. C6 is connected between the output of this voltage divider and line L2. Also connected to the voltage divider's output is the input of Schmitt trigger ST1, an integrated circuit. The output of ST1 is connected to the input of flip-flop FF1, a bi-stable multivibrator which is also an integrated circuit. The output of oscillator 300 is connected to the input of a second Schmitt trigger, ST2, which is connected to a second flip-flop, FF2. The outputs of FF1 and FF2 are connected together through a single L.E.D., D8, to the output of power supply 100 such that D8 will emit light whenever either FF1 or FF2 is conductive to the return of power supply 100. The light from D8 is intended to fall on TRIAC T3, a light-activated device in the same package as D8 in what is known as an optical isolator.

In operation, D7 and R18 deliver a transit signal to St1 on initial application of power at S1. (C6 starts with no voltage across it and increases to the potential of the voltage divider's output.) ST1 then causes FF1 to be conductive, drawing current through D8. The resulting light from D8 activates T3 so that T1 is conductive early in each AC half cycle. The light from load 500 will, therefore, be continuous at the first closure of S1.

Now assuming that the capacitance of C6 is small compared to that of C1, a brief opening and closing of S1 will create another input signal for St1 which will cause a toggle of FF1 to a non-conductive state. D8, for the moment, will not furnish light for T3.

Meanwhile, oscillator 300 (which is active at all times that S1 is closed) is supplying St2 with input signals sufficient for ST2 to create periodic inputs to FF2. Each such input causes a toggle in FF2 so that it becomes conductive on every other input. Whenever FF2 is conductive but FF1 is non-conductive, D8 is energized on a periodic basis, causing T3,T1 and load 500 to be conductive on the same basis.

Unlike previously described embodiments, this embodiment reacts to subsequent brief interruptions of power by alternating the mode of operation on each brief interruption. That is, a flashing light at load 500 can be changed back to a steady light by a second brief interruption at S1, and this mode can be changed back to a flashing mode by a third brief interruption, etc.

It should be noted that certain types of flip-flops may not require Schmitt triggers for waveform shaping, as shown, depending on their design performance.

One skilled in the art may devise other versions of subcircuits for the power supply, logic circuit, oscillator and power switch of the described control circuit without departing from the spirit of the present invention. A power switch circuit that employs a relay, for example, may be substituted for those taught herein without changing the overall operation of the control circuit.

Likewise, other combinations and arrangements of these elements may be useful. Load 500, for example can be a DC-type load if T1 is a SCR rather than a TRIAC. Load 500 can also be placed in certain other locations relative to power switch 400, if desired for some reason. Also, most of the embodiments will work equally well with a DC source in place of the AC (alternating current) source that is shown.

What is claimed is:

1. A control circuit for controlling the application of power to an electrical load comprising:
   (a) first and second input terminals for receiving the application of power from an electrical power source,
   (b) first and second output terminals for coupling said circuit to an electrical load; and
   (c) power control means, coupled between said input and output terminals, for causing power to be coupled to said output terminals and thereby said load in accordance with a first prescribed timing characteristic in response to the termination, at said input terminals, of a power interruption that has lasted for a period of time in excess of a prescribed period of time, and for causing power to be coupled to said output terminals and thereby said load in accordance with a second prescribed timing characteristic, different from said first prescribed timing characteristic, in response to the termination of a power interruption that has lasted for a period of time equal to or less than said prescribed period of time.

2. A control circuit according to claim 1 wherein said first prescribed timing characteristic corresponds to the effectively continuous application of power to said load during the application of power to said input terminals, and said second prescribed timing characteristic corresponds to the repeated application and interruption of power to said load.

3. A control circuit according to claim 1 wherein said first prescribed timing characteristic corresponds to the effectively continuous application of power to said load during the application of power to said input terminals, and said second prescribed timing characteristic corresponds to a periodic application of power to said load.

4. A control circuit according to claim 1. wherein said power control means comprises:
   (a) a controlled switch means coupled in circuit between said input and output terminals; and
   (b) control signal generator means, coupled to said controlled switch and responsive to the application of power to said input terminals, for controllably operating said controlled switch and thereby a circuit connection between said input and output terminals in accordance with the interruption of power to said input terminals.

5. A control circuit according to claim 4 wherein said control signal generator means includes means for providing a periodic signal and means, responsive to the termination of a power interruption at said input terminals that has lasted for a period of time equal to or less than said prescirbed period of time, for operating said controlled switch in accordance with said periodic signal.

6. A control circuit for use with a system having an electrical power source and a manually operated switch coupled by electrical transmission lines to an electrical load, said control circuit comprising:
   (a) coupling means for connecting said control circuit between said transmission lines and said load;
   (b) oscillator means for producing a periodic control signal;

(c) a logic circuit coupled to said oscillator means and said transmission lines responsive to power interruptions in said transmission lines when said manually operated switch is opened and closed, causing an effectively continuous control signal from said oscillator means at the termination of an interruption that is longer than a prescribed period of time and causing a periodic control signal from said oscillator means at the termination of an interruption that is shorter than a prescribed period of time; and (d) controlled switch means connected to said coupling means and said oscillator means that provides effectively continuous power to said load in response to said continuous control signal from said oscillator means and periodic power to said load in response to said periodic control signal from said oscillator means.

7. The control circuit of claim 6 where said power source is of the alternating current type and said control circuit includes power supply means for converting AC power to DC power.

8. The control circuit of claim 6 where said control circuit is located adjacent to said load, and said manually operated switch is located remote from said load.

9. The control circuit of claim 6 where said logic circuit is comprised of first and second signal inverting means connected to a plurality of resistors and one or more capacitors such that when said power interruption is longer than a prescribed period of time said first inverting means is conductive and said second inverting means is non-conductive, but when said power interruption is shorter than prescribed period of time said second inverting means becomes conductive and said first inverting means becomes non-conductive.

10. The control circuit of claim 9 where said first and second signal inverting means are semiconductor devices.

11. The control circuit of claim 6 where said logic circuit includes a thyristor and a transistor connected to a plurality of resistors and a capacitor such that when said power interruption if longer than a prescribed period of time said thyristor becomes conductive before said transistor becomes conductive, but when said power interruption is shorter than a prescribed period of time said transistor prevents said thyristor from being conductive.

12. The control circuit of claim 6 where said logic circuit includes a thyristor connected to a resistor/capacitor/diode network such that thyristor is not conductive when said power interruption is longer than a prescribed period of time, but when said power interruption is shorter than a prescribed period of time said thyristor becomes conductive.

13. The control circuit of claim 6 where said controlled switch means includes a thyristor, one or more transistors and coupling emans such that said transistors control the conductivity of said thyristor according to said signals from said logic circuit and said oscillator means.

14. The control circuit fo claim 6 where said controlled switch means includes a thyristor and optical coupling means to control the conductivity of said thyristor according to said control signals form said logic circuit and said oscillator means.

15. A control circuit for use with a system having an electrical power source and a manually operated power switch coupled by electrical transmission lines to an electrical load, said control circuit comprising:

(a) coupling means for connecting said control circuit between said transmission lines and said load;

(b) oscillator means for producing a periodic control signal;

(c) a logic circuit coupled to said oscillator means and said transmission lines, responsive to power interruptions in said transmission lines from said manually operated power switch such that an effectively continuous control signal is produced from said oscillator means following a power interruption that is longer than a prescribed period of time, after which, periodic control signals and effectively continuous control signals are alternately provided following each power interruption that is shorter than a prescribed period of time; and (d) controlled switch means connected to said coupling means and said oscillator means that provides effectively continuous power to said load in response to said effectively continuous control signal from said oscillator means and periodic power to said load in response to said periodic control signal from said oscillator means.

16. The control circuit of claim 15 where said logic circuit includes first and second bi-stable multivibrators with coupling means between outputs of said multivibrators and said controlled switch means, a resistor/capacitor/diode network connected between the input of said first multivibrator and said transmission lines to cause a toggle of said first multivibrator when said power interruption is shorter than a prescribed period of time, and coupling means between the input of said second multivibrator and said oscillator means of said control circuit.

17. The control circuit of claim 15 where said controlled switch means includes a thyristor, one or more transistors and coupling means such that said transistors control the conductivity of said thyristor according to said signals from said logic circuit and said oscillator means.

18. The control circuit of claim 15 where said controlled switch means includes a thyristor and an optical coupling means to control the conductivity of said thyristor according to said signals from said logic circuit and said oscillator means.

19. A method for selectively supplying either continuous power or periodic power to an electrical load under control of a remotely located, manually operated power switch comprising:

(a) connecting a controlled switch means in series with said load;

(b) coupling an oscillator means to said controlled switch to provide control signals for said controlled switch;

(c) coupling logic means to said oscillator means to respond to interruptions of power from said manually operated power switch, whereas at the termination of a power interruption longer than a prescribed period of time said logic means causes said oscillator means to provide an essentially continuous control signal to said controlled switch means which in turn causes said load to receive effectively continuous power, and at the termination of a power interruption shorter than a prescribed period of time said logic means causes said oscillator means to provide a periodic control signal to said controlled switch means which in turn causes said load to receive periodic power.

* * * * *